US005698356A

United States Patent [19]

Murata et al.

[11] Patent Number: 5,698,356

[45] Date of Patent: Dec. 16, 1997

[54] METHOD OF MANUFACTURING DEVELOPING AGENT

[75] Inventors: Hiroshi Murata; Takao Izumi; Yuka Nakamura; Etsuko Miyamoto, all of Yokahoma, Japan

[73] Assignee: Kabushiki Kaisha Toshiba, Kawasaki, Japan

[21] Appl. No.: 618,779

[22] Filed: Mar. 20, 1996

[30] Foreign Application Priority Data

Mar. 22, 1995 [JP] Japan ..... 7-062503

[51] Int. Cl.[6] ..... G03G 9/087

[52] U.S. Cl. ..... 430/106; 430/137

[58] Field of Search ..... 430/137, 109, 430/106; 252/511

[56] References Cited

U.S. PATENT DOCUMENTS

| | | | |
|---|---|---|---|
| 4,071,670 | 1/1978 | Vanzo et al. | 526/88 |
| 5,380,615 | 1/1995 | Tokuno | 430/137 |
| 5,397,671 | 3/1995 | Bayley et al. | 430/137 |
| 5,496,676 | 3/1996 | Croucher et al. | 430/137 |
| 5,575,954 | 11/1996 | Mahabadi et al. | 430/137 |

FOREIGN PATENT DOCUMENTS

| | | |
|---|---|---|
| 53-17735 | 2/1978 | Japan . |
| 63-186253 | 8/1988 | Japan . |

*Primary Examiner*—John Goodrow
*Attorney, Agent, or Firm*—Foley & Lardner

[57] ABSTRACT

A method of manufacturing a developing agent, comprising the steps of forming a aggregate containing resin particles and a colorant, forming a dispersion by dispersing the aggregate, a first polymerizable monomer, and a semi-polymerizable monomer in a solvent, the semi-polymerizable monomer being obtained by partially polymerizing a second polymerizable monomer, forming a composite seed containing the aggregate, the first polymerizable monomer, and the semi-polymerizable monomer by stirring the dispersion to granulate the aggregate and polymerizing the composite seed in the presence of a soap-free polymerization initiator.

18 Claims, 3 Drawing Sheets

METHOD OF MANUFACTURING DEVELOPING AGENT

BACKGROUND OF THE INVENTION

1. Field of the Invention

This invention relates to a method of manufacturing a developing agent to be used for developing an electrostatic charge image in an electrophotography, an electrostatic recording or an electrostatic printing.

2. Description of the Related Art

The use of a polymer toner is known in the field of a developing agent for developing an electrostatic charge image in an electrophotography, an electrostatic recording or an electrostatic printing. The polymer toner is manufactured through a polymerization and containing a colorant etc. in the polymer particles thereof. The manufacture of the polymer toner in an aqueous medium can be classified generally into an emulsion polymerization particle agglomeration method and a suspension polymerization method. Among them, the conventional emulsion polymerization particle-agglomeration method as described in Japanese Patent Unexamined Publication S63-186253 is featured in causing primary particles each being about 2 μm in particle size to agglomerate with each other into larger particles so that the size of toner can be controlled within the range of several microns to several tens microns, though it is difficult to continuously control the particle size. Furthermore, the toner obtained by this emulsion polymerization particle agglomeration method is poor in humidity resistance, since a surfactant may be left remained in the toner particles.

On the other hand, according to the conventional suspension polymerization method as disclosed in Japanese Patent Publication S53-17735, the problem of deterioration in humidity resistance of toner can be somewhat alleviated as compared with the aforementioned emulsion method. However, the range of particle size that can be controlled by the suspension method is relatively narrow, i.e., from 5 μm to several tens microns so that the merit of polymerization method regarding the minimization of the toner particle size can not be fully taken advantage of.

In view of solving above problems, the use of a soap-free polymerization method which is capable of controlling the particle size of toner in a wide range and can be practiced without requiring the employment of a surfactant is now considered as being a preferable method for manufacturing a toner. However, it has been found very difficult to put such a soap-free polymerization method into practical use because of the following reasons.

(1) It is necessary according to the soap-free polymerization method to disperse all of the components of a toner in an aqueous medium. However, it is very difficult to disperse all of the components of a toner in an aqueous medium. Accordingly, it is impossible to cause all of the components to be contained in a polymer particle during the formation of the particle.

(2) According to the soap-free polymerization method, the minimum particle size to be obtained is several microns so that it is impossible to obtain particles having a suitable range of particle size desired for use as a toner.

SUMMARY OF THE INVENTION

Accordingly, an object of the present invention is to provide a method of manufacturing a developing agent, which is capable of allowing additives for a toner to be fully contained within the toner, of obtaining a toner excellent in humidity resistance and suitable in particle diameter for use as a toner, and of easily controlling the particle diameter of a toner to range from submicron to several tens microns, though the manufacturing method thereof is based on a soap-free polymerization method.

Another object of this invention is to provide a composite seed particle suited for use in the manufacture of a developing agent.

Another object of this invention is to provide a developing agent which can be produced by the aforementioned method.

Namely, according to the present invention, there is provided a method of manufacturing a developing agent, comprising the steps of: forming a aggregate containing resin particles and a colorant; forming a dispersion by dispersing the aggregate, a first polymerizable monomer, and a semi-polymerizable monomer in a solvent, the semi-polymerizable monomer being obtained by partially polymerizing a second polymerizable monomer; forming a composite seed containing the aggregate, the first polymerizable monomer, and the semi-polymerizable monomer by stirring the dispersion to granulate the aggregate; and polymerizing the composite seed in the presence of a soap-free polymerization initiator.

According to the present invention, there is further provided a method of manufacturing a composite seed particles comprising the steps of: forming a aggregate containing resin particles and a colorant; forming a dispersion by dispersing the aggregate, a first polymerizable monomer, and a semi-polymerizable monomer in a solvent, the semi-polymerizable monomer being obtained by partially polymerizing a second polymerizable monomer; and forming a composite seed containing the aggregate, the first polymerizable monomer, and the semi-polymerizable monomer by stirring the dispersion to granulate the aggregate.

Further, according to the present invention, there is also provided a developing agent produced by the method comprising the steps of: forming a aggregate containing resin particles and a colorant; forming a dispersion by dispersing the aggregate, a first polymerizable monomer, and a semi-polymerizable monomer in a solvent, the semi-polymerizable monomer being obtained by partially polymerizing a second polymerizable monomer; forming a composite seed containing the aggregate, the first polymerizable monomer, and the semi-polymerizable monomer by stirring the dispersion to granulate the aggregate; and polymerizing the composite seed in the presence of a soap-free polymerization initiator.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

This invention will be further explained with reference to the following preferred embodiment of this invention.

Figure 1:
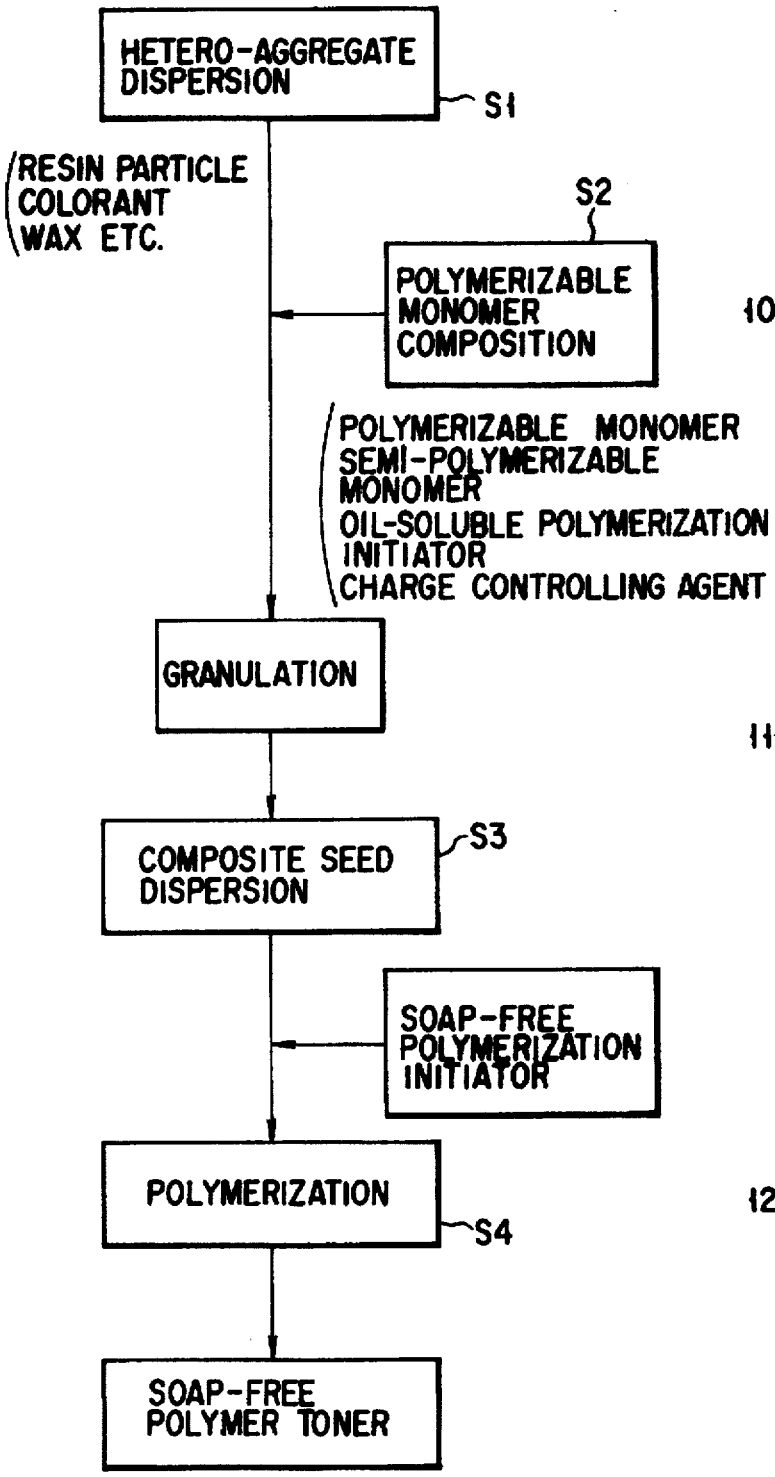
FIG. 1 is a flow diagram illustrating a manufacturing method of a soap-free polymer toner according to this invention.

FIG. 1 shows a procedure of manufacturing a developing agent according to this invention. As shown in FIG. 1, the method of this invention is constituted by the following steps.

(1) Step S1 of Manufacturing Hetero-Aggregate Dispersion

A hetero-aggregate comprising resin particles of the order of submicron in particle diameter obtained by a soap-free polymerization and a colorant are dispersed in an aqueous medium. In this case, wax etc. can be added to the aqueous medium if desired. In this aqueous dispersion, the colorant and wax incorporated therein are left free as a simple substance respectively.

The aqueous dispersion of the hetero-aggregate is obtained by a process comprising the steps of synthesizing a negative-charge type resin particle through a soap-free polymerization, mixing the resin particle with a colorant dispersed in a positively charged aqueous medium, and electrostatically agglomerating the mixture by using an ultrasonic dispersing apparatus or a nanomizer thereby to obtain an aqueous dispersion containing hetero-aggregates dispersed therein. When wax etc. is desired to be incorporated therein, a negative-charge type self-emulsifiable emulsion wax is mixed in the mixture in advance and then the mixture is electrostatically agglomerated by using an ultrasonic dispersing apparatus or a nanomizer thereby to obtain an aqueous dispersion containing hetero-aggregates dispersed therein.

(2) Step S2 of Adding Polymerable Monomer Composition

A polymerizable monomer composition comprising a polymerizable monomer, an oil-soluble polymerization initiator and a semi-polymerizable monomer (semi-polymer) is added in the aqueous dispersion obtained in the step (1). In this case, a charge controlling agent may preferably be added in the aqueous dispersion.

The polymerizable monomer composition used herein is meant to comprise a polymerizable monomer, a semi-polymerizable monomer, an oil-soluble polymerization initiator and optionally, a charge controlling agent. This polymerizable monomer composition can be prepared by the steps of mixing a polymerizable monomer with an oil-soluble polymerization initiator to prepare a first solution, separately mixing a semi-polymerizable monomer with a charge controlling agent to prepare a second solution, and then mixing the first solution with the second solution. The semi-polymerizable monomer used herein is meant a monomer, a portion of which is thermally polymerized into a polymer, thus exhibiting a somewhat more viscous fluid as compared with the monomer. This semi-polymerizable monomer can be obtained by allowing a polymerizable monomer to stand overnight at a temperature of 60° C. in a drying oven.

More specifically, the term, semi-polymerizable monomer is used herein to mean a monomer which is partially polymerized. This semi-polymerizable monomer can be obtained by heating a polymerizable monomer in the presence in a little amount of an oil-soluble polymerization initiator to initiate the polymerization of the polymerizable monomer. The resultant semi-polymerizable monomer thus obtained is a fluid material which is more viscous than that of the pure monomer. The molecular weight of the polymerized portion of the semi-polymerizable monomer should preferably be in the range of 1 millions to 4 millions. The ratio of the polymerized portion to the semi-polymerizable monomer should preferably be not more than 50% by weight, more preferably in the range of 10 to 40% by weight.

(3) Step S3 of Manufacturing Composite Seed Dispersion

The resultant mixture comprising the polymerizable monomer composition and the aqueous dispersion obtained in the step (1) is stirred, hence granulating the mixture into a composite seed particle. In this case, the particle diameter of the composite seed particle can be controlled by controlling the stirring conditions such as temperature, stirring force and stirring time.

In this case, the composite seed particles comprises a hetero-aggregate, a polymerizable monomer composition, a free colorant and wax. Whereas, the dispersion of the composite seed particles contains a substantial amount of free polymerizable monomer.

(4) Step S4 of Polymerization

A water-soluble soap-free polymerization initiator which is a soap-free polymerization initiator is added into the aqueous dispersion containing the resultant composite seed particle to carry out the polymerization of the composite seed particle. With this polymerization, the interior of the composite seed particle is polymerized by the effect of the oil-soluble polymerization initiator and the exterior of the composite seed particle is polymerized via the soap-free polymerization, thus consuming free polymerizable monomer and improving the humidity resistance of the surface of the resultant developing agent.

The method of this invention is featured in that the semi-polymerizable monomer is employed in the granulating step (3) in order to effectively incorporate various toner components into the toner particle. When the semi-polymerizable monomer is employed in this manner, the colorant and wax can be effectively dispersed internally into the toner without leaving the colorant and wax in the aqueous medium that otherwise might be resulted if only the hetero-aggregate of the step (1) is employed. Moreover, with the addition of this semi-polymerizable monomer in the step (2), it has also become possible to allow a charge controlling agent etc. to be effectively dispersed into the interior of toner, that has been considered very difficult if the conventional soap-free method is employed.

According to the conventional soap-free polymerization method, the minimum diameter that can be obtained is at most several microns, which is too small to be used as a developing agent. However, according to this invention, it is possible to perform the enlargement in particle diameter of polymer particle through the granulating step (3) for forming the composite seed particle by making use of the semi-polymerizable monomer and through the polymer growth step (4) for polymerizing the composite seed particle to turn it into a toner by making use of a soap-free polymerization initiator.

Further, since the hetero-aggregate and the polymerizable monomer composition are stirred together so as to be granulated into a larger particle, it is possible according to this invention to control the particle diameter of a toner to continuously range from submicron to several tens microns.

The reason that make it possible according to method of this invention to effectively disperse a colorant, a wax, etc. in a toner may be attributed to a phenomenon that the components left free in the aqueous medium such as the colorant etc. are taken up by the high polymer matrix of the semi-polymerizable monomer and taken into the composite seed particle. It is also considered that since the hetero-aggregate and the polymerizable monomer composition are immediately granulated into a composite seed particle, there is much possibility that the polymerizable monomer is made ready to swell. Additionally, although most of the polymerizable monomer is liberated in the aqueous medium, it has been observed that the polymerizable monomer can be readily consumed by the soap-free polymerization. These phenomena are distinctive features that make the method of this invention distinguished from the ordinary swelling-sheet polymerization using a surfactant.

When the stirring force is controlled as a method for controlling the particle diameter of toner in the granulating step for forming a composite seed particle, the particle diameter can be controlled within a wide range extending from submicron to several tens microns. The reason for this may be explained as such that the hetero-aggregate constituting the composite seed particle is as small as submicron.

Figure 2:
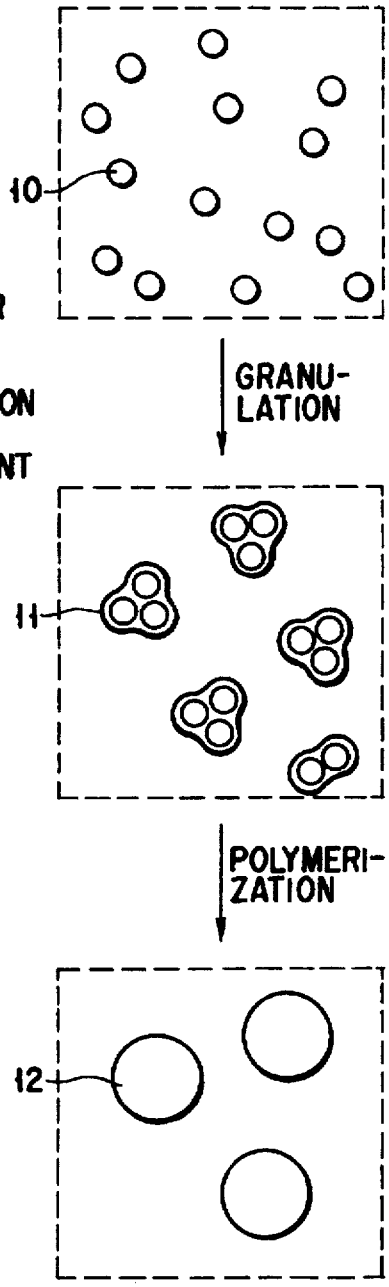
FIG. 2 is a schematic diagram illustrating the process of forming the particles of a soap-free polymer toner according to this invention.

FIG. 2 schematically illustrates a process of the growth of particles in the method of this invention. As indicated in FIG. 2, according to this invention, a hetero-aggregate 10 having a particle diameter of about 0.9 μm is granulated into a composite seed particle 11 having a particle diameter of about 6 μm, which is then polymerized through the soap-free polymerization to become a toner 12 having a particle diameter of about 10 μm. In this case, the control of particle diameter of the toner is mainly performed by adjusting the mechanical stirring force of a stirring apparatus such as a homogenizer in the step of granulating the composite seed particle. The main factors in this mechanical stirring are the stirring force and stirring time, i.e. the larger the stirring force and the longer the stirring time, the larger the particle size of the composite seed particle becomes, which is quite contrary to the phenomenon in the suspension polymerization. Therefore, it is possible to continuously obtain a composite seed particle ranging from submicron to several tens microns.

Figure 3:
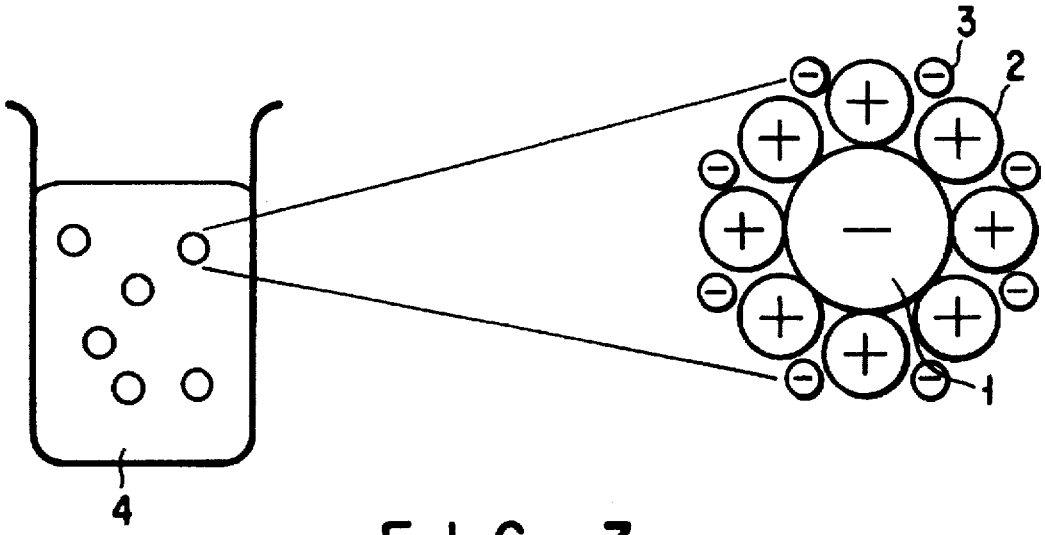
FIG. 3 is a schematic diagram illustrating the structure of a hetero-aggregate to be used in this invention.

The model diagram of the hetero-aggregate to be used in this invention is shown in FIG. 3. As shown in FIG. 3, the hetero-aggregate to be used in this invention comprises a resin particle 1, colorant particles 2 cohered onto the circumference of the resin particle 1 and wax particles 3 cohered onto the circumference of the colorant particles 2. The dispersion 4 of the hetero-aggregate is formed of an aqueous medium and a large number of the hetero-aggregates dispersed in the aqueous medium, each hetero-aggregate comprising aforementioned components cohered with each other via electrostatic attracting force. The size of the hetero-aggregate is generally in the range of 0.1 to 1 μm, preferably 0.5 to 1 μm in average particle diameter, the specific size thereof being substantially determined depending on the size of the resin particle.

As for the resin particle, it is possible to employ any kind of resin particles, i.e. one which is commercially available or one which is synthesized. As a raw material for the resin particle, a polymer which can be obtained by polymerizing, through a soap-free polymerization method, one or more of polymerizable monomers to be used in this invention can be used. Specific examples of such material for the resin particle are polystyrene, styrene-acrylate copolymer, styrene-methacrylate copolymer, styrene-acrylonitrile copolymer, styrene-butadiene copolymer, polyethylene, polypropylene, polyurethane, polyester resin, epoxy resin, silicone resin, polyamide and paraffin. The weight-average molecular weight of these polymers should preferably be in the range of 10,000 to 500,000. The average particle diameter of these polymers should preferably be in the range of 0.1 to 1 μm, more preferably 0.5 to 1 μm.

Examples of the coloring agent are inorganic pigments (those available in nature, chromates, ferrocyane compounds, oxides, chlorides, sulfides, silicates, metal powders), organic pigments (natural dye lake, nitroso group, azo group, phtharocyanine group, condensed polycyclic group, basic dye lake, mordant dye group, vat dye group), water-soluble dyes, and oil-soluble dyes. Specific examples of the inorganic pigments are natural pigments such as loess; chromates such as chrome yellow, zinc yellow, barium yellow, chrome orange, molybdenum red, chrome green; ferrocyane compounds including Prussian blue; oxides such as titanium oxide, titanium yellow, titanium white, red iron oxide, yellowish iron oxide, zinc ferrite, zinc white, iron black, cobalt blue, chrome oxide, and spinel green; sulfides such as cadmium yellow, cadmium orange, and cadmium red; sulfates including barium sulfate; silicates such as calcium silicate and ultramarine; metal powders such as bronze and aluminum; and carbon black. Specific examples of the organic pigments are natural lakes including madder lake, nitroso pigments such as naphthol green and naphthol orange; azo-pigments including: soluble azo-pigments such as benzidine yellow G, Hansa yellow G, Hansa yellow 10G, Vulcan orange, lake red R, lake red C, lake red D, Watching red, brilliant carmine 6B, pyrazolone orange, Bordeaux 10G (bonmaroom); insoluble azo-pigments such as pyrazoline red, Para red, toluidine red, ITR red, toluidine red (lake red 4R), toluidine maroon, Brilliant Fast Scarlet, lake bordeaux 5B; and condensed azo-pigments; phthalocyanine pigments such as phthalocyanine blue, phthalocyanine green, bromo-phthalocyanine green, and Fast Sky blue; condensed polycyclic pigments including: anthraquinone pigment such as slen blue; perylene pigment such as perylene maroon; perinone pigment such as perinone orange; quinacridone pigment such as quinacridone and dimethyl quiacridone; dioxadine pigment such as dioxadine violet; isoindoline pigment; and quinophtalone pigment; basic dye lakes such as Rohdamine 6b lake, Rohdamine lake B, and Malachite green; mordant dye-based pigments including alizarine lake; vat dye-based pigments such as indanthrene blue, indigo blue, and anthoanthorone orange; fluorescent pigments; azine pigments (diamond black); and green gold. Specific examples of the water-soluble dyes are basic dyes including Rohdamine B, acidic dyes, fluorescent dyes. Specific examples of the oil-soluble dyes are monoazo-dyes such as Fast orange R, oil red, and oil yellow; anthraquinone dyes such as anthraquinone blue, and anthraquinone violet; azine dyes such as nigrosine and induline; and basic, acidic, and metal complex compound-based dyes. The content of these colorants should preferably be in the range of 0 to 30% by weight, more preferably 1 to 10% by weight based on the toner.

As for the dispersant for the colorants, anionic dispersants such as a fatty salt type compound containing —$COONH_4$, a sulfate salt type compound containing —$OSO_3NH_4$, phosphate salt type compound containing —$OPO_3(NH_4)_2$; and cationic dispersants such as amine salts including primary, secondary and tertiary alkyl amines; primary, secondary and tertiary ethanol amines; polyethylene polyamines; ethylene oxide adducts of alkylamine may be employed.

Specific examples of such a dispersant include compounds having a styrene derivative structure as represented by the following general formula (1) shown below:

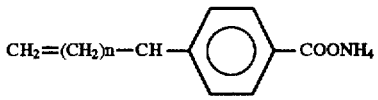

(1)

wherein n represents an integer ranging from 1 to 10.

Another example of such a dispersant include compounds having an acrylate derivative structure as represented by the following general formula (2):

$$CH_2{=}CR_1COO(CH_2)_n{-}NR_2R_3 \quad (2)$$

wherein n represents an integer ranging from 1 to 10; $R_1$, $R_2$, and $R_3$ represent alkyl group having 1 to 6 carbon atoms.

Still another example of such a dispersant include compounds having a styreneacrylate copolymer derivative structure as represented by the following general formula (3):

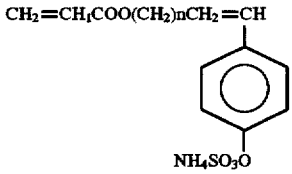

(3)

wherein n represents an integer ranging from 1 to 10; $R_1$ represents alkyl group having 1 to 6 carbon atoms.

The content of these dispersants should preferably be in the range of 0.01 to 30% by weight, more preferably 0.1 to 15% by weight based on the toner. In particular, amines are preferable for use as a dispersant for these colorants in view of its excellent humidity resistance.

As for the wax, low molecular weight polyethylene, low molecular weight polypropylene, or paraffin may be employed. For the purpose of allowing a wax to be dispersed in an aqueous medium, it may be advisable to employ a carboxyl group-modified polyolefin of emulsion type such as a self-emulsifiable polyethylene wax or polypropylene wax, which can be obtained by modifying the skeleton of ethylene, propylene, butene-1 or pentene-1 so as to contain a carboxyl group and then by at least partially neutralizing the resultant modified polyolefin with ammonia or amine. The content of wax in a toner should preferably be 0 to 30% by weight, more preferably 1 to 10% by weight based on the toner.

Figure 4:
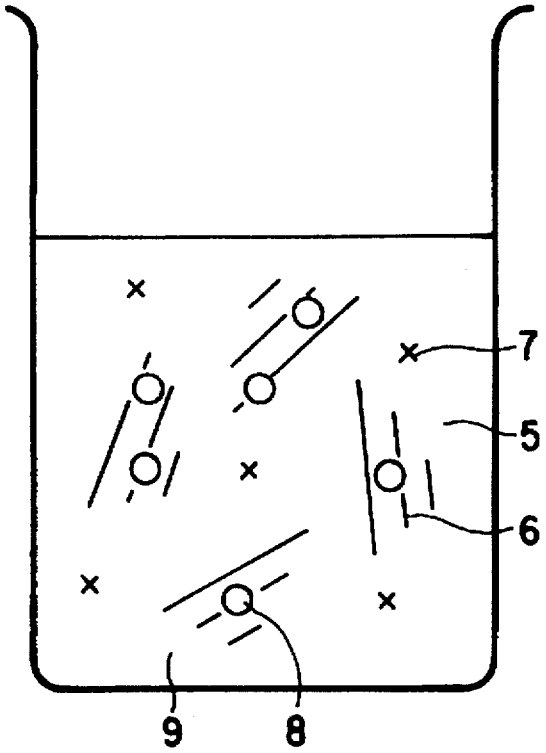
FIG. 4 is a schematic diagram illustrating a polymerizable monomer composition to be used in this invention; and The FIG. 5 is a cross-sectional view of one example of a color image-forming apparatus to be used in this invention.

FIG. 4 illustrates a model diagram of a polymerizable monomer composition to be used in this invention. As shown in FIG. 4, the polymerizable monomer composition 9 comprises a polymerizable monomer 5, a semi-polymerizable monomer 6, an oil-soluble polymerization initiator 7 and a charge controlling agent 8 or a fine particulate external additive for controlling charge.

Examples of the polymerizable monomer are a monovinyl aromatic monomer, an acryl-based monomer, vinylester-based monomer, vinylether-based monomer, diolefin-based monomer and mono-olefin-based monomer. Specific examples of monovinyl aromatic monomer are monovinyl aromatic hydrocarbons such as styrene, a-methylstyrene, vinyltoluene, a -chlorostyrene, o-, m- or p-chlorostyrene, p-ethylstyrene, divinylbenzene, and a combination of two or more of them. Specific examples of the acryl-based monomer are methyl acrylate, ethyl acrylate, butyl acrylate, 2-hexyl acrylate, cyclohexyl acrylate, phenyl acrylate, methyl methacrylate, hexyl methacrylate, 2-ethylhexyl methacrylate, ethyl b-hydroxyacrylate, g-propyl hydroxyacrylate, d-butyl hydroxyacrylate, b-ethyl hydroxymethacrylate, ethylene glycol methacrylic ester and tetraethylene glycol dimethacrylic ester. Specific examples of the vinylester-based monomer are vinyl formate, vinyl acetate and vinyl propionate. Specific examples of the vinylether-based monomer are vinylmethyl ether, vinylethyl ether, vinyl-n-butyl ether, vinylphenyl ether and vinylcyclohexyl ether. Specific examples of the diolefin-based monomer are butadiene, isoprene and chloroprene. Specific examples of the mono-olefin-based monomer are ethylene, propylene, isobutylene, butene-1, pentene-1 and 4-methylpentene-1.

The content of the semi-polymerizable monomer in the polymerizable monomer composition should preferably be 2 to 15% by weight. If the content of the semi-polymerizable monomer exceeds over 15% by weight, the average molecular weight of the toner is so increased that the region occupied by a high polymer in the molecular weight distribution is increased, thus possibly deteriorating the fixing ratio of toner. On the other hand, if the content of the semi-polymerizable monomer is less than 2% by weight, the effect of this invention can not be achieved in a sufficient degree.

Examples of the oil-soluble polymerization initiator are an azo compound such as azobisbutylonitrile which is soluble to the monomer, and a peroxide such as cumenehydroxy peroxide, dicumyl peroxide, benzoyl peroxide and lauroyl peroxide. A preferable range of content of this oil-soluble polymerization initiator is 0.01 to 10% by weight, more preferably 0.1 to 5% by weight based on the polymerizable monomer.

With regard to the charge controlling agent, an electron-donating material such as nigrosin dye and a quaternary ammonium salt may be used as a negative-charge type controlling agent; and also an electron-accepting material such as a metal salt of monoazo-dye may be used as a positive-charge type controlling agent.

Examples of the fine particulate external additive for controlling charge are metal oxides such as silicon oxide, titanium oxide, zinc oxide, aluminum oxide, tin oxide, indium oxide and cerium oxide; metal salts of fatty acid such as zinc stearate, calcium stearate and lead stearate; inorganic materials such as barium titanate, strontium titanate, basic bismuth acetate; PMMA; styrene-acryl copolymer; fluorine plastics such as vinylidene fluoride and tetrafluoroethylene. These charge controlling agent and fine particulate external additive for controlling charge may be conveniently added to the toner by mixing them with the semi-polymerizable monomer.

The composite seed particle to be used in the method of this invention can be obtained by mixing the hetero-aggregate and the polymerizable monomer composition of this invention, and then granulating the resultant mixture. The mixing in this granulating step can be performed by a mechanical stirring using for example an ordinary emulsifying apparatus such as a homogenizer; a suspension-forming apparatus, a mixer and a magnetic stirrer; or by an ultrasonic stirring. These apparatuses may be used for pulverizing a resin particle which has been swelled by the addition of a resin monomer, but are utilized in the method of this invention to carry out the granulation and enlargement of particles.

The water-soluble polymerization initiator to be employed in this invention is a reactive emulsifier or a reactive surfactant, any of which are a soap-free polymerization initiator. Preferable examples of such a soap-free polymerization initiator are persulfates such as ammonium persulfate, sodium persulfate and potassium persulfate; DEAM (N,N'-diethylaminoethyl methacrylate); and AIBN.2HCl (isobutylamide hydrochloric acid). It is also possible as a soap-free polymerization initiator to use an acetate such as polyoxyethylene methacrylate, dimethylaminoethyl methacrylate and diethylaminoethyl methacrylate.

The content of this water-soluble polymerization initiator should preferably be 0.01 to 10% by weight, more preferably 0.1 to 5% by weight based on the polymerizable monomer.

The solid content to be charged into the reaction in the method of this invention is in general 1 to 30% by weight, preferably 3 to 20% by weight. The average particle diameter of the toner should preferably be 1 to 100 μm, more preferably 2 to 20 μm. The polymerization temperature should preferably be 40° to 100° C., and the polymerization time should preferably be 1 to 24 hours.

Figure 5:
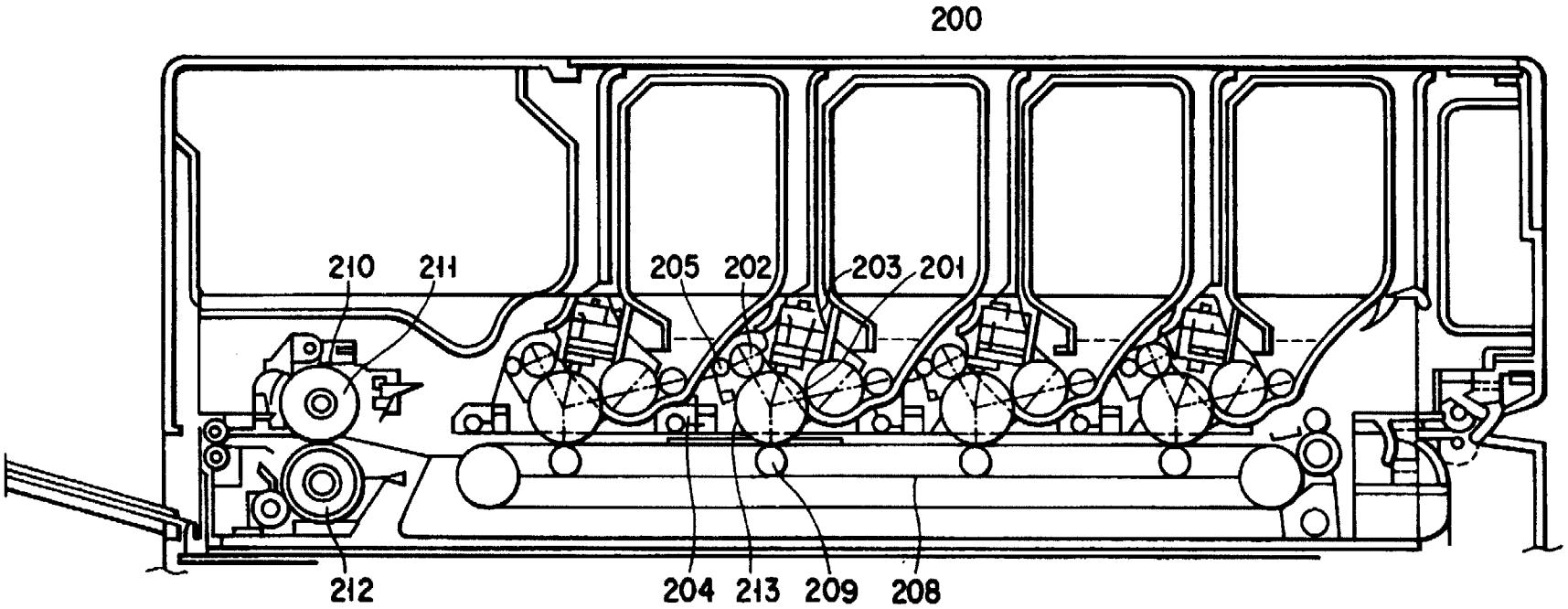

FIG. 5 illustrates one example of an image-forming apparatus to which the toner for electrophotography of this invention can be applied. In this image-forming apparatus, a unit comprising a photosensitive body 201, a charging device 202, a laser exposure device 203, a development device 200, a transferring device 209, a blade cleaning device 204 and deelectrifying lamp 205 is disposed for each of four colors, i.e. black, yellow, magenta and cyan.

In this image-forming apparatus, a transfer medium 213 such as paper or OHP sheet is supplied from the direction of the arrow onto a transfer belt 208, and then a transferring voltage from the transferring device 209 disposed below the transfer belt 208 is applied through the transfer belt 208 to the portion of the transfer medium 213 which is in contact with the photosensitive body 201, thereby allowing the developed toner on the photosensitive body 201 to be transferred onto the transfer medium 213. This process is repeated for each of four colors, thus superimposing each toner image one another on the transfer medium 213.

As for the transferring device 209, one provided with a resilient roller to which a bias voltage is applied can be employed. The toner images superimposed one upon another on the transfer medium 213 are heated as they pass through between a heat roller 211 and a compression roller 212, and are fixed on the transfer medium, thereby forming a full color image.

The toner of this invention was used as a developing agent for a printer provided with a heat roller thermal fixing device heated to a surface temperature of 128° C. (nip width: 7.5 mm) and a blade cleaning device. The printings of images of letters, lines, a 20 mm square solid black patch, and a patch of intaglio half-tone were conducted at process speed of 105 mm/sec. Further, this toner was mixed with a ferrite carrier 60 μm in average particle diameter at a mixing ratio of 100:4 (based on weight) to obtain a binary mixture, which was then used for a printer comprising a binary-component developing device, a heat roller thermal fixing device heated to a surface temperature of 128° C. (nip width: 7.5 mm) and a blade cleaning device, and having a capacity of process speed of 65 mm/sec. Then, printings of images were conducted in the same manner as mentioned above. In these printings, the following assessments were conducted.

Moisture Resistance-Fogging Test

Polymer toner obtained was allowed to dry for 50 hours at a temperature of 45° C., and then the aforementioned printing of image was repeatedly performed 1,000 times using the polymer toner under the conditions of 20° C. in temperature and 50% in humidity (N/N), wherein at the occasion of the 1,000th printing, a commercially available mending type was applied to the latent image on the photosensitive body, and printing was performed to measure the luminosity (%) of the printed image. Thereafter, the polymer toner was left for 12 hours under the conditions of 30° C. in temperature and 85% in humidity (H/H), and then the mending type was applied to the first latent image on the photosensitive body. Printing was performed using the polymer toner to measure the luminosity (%) of the printed image. Then, the former luminosity was compared with the latter luminosity to investigate the difference in luminosity between them. Namely, a toner sample indicating a difference of 5% or more was marked by "x", and a toner sample indicating a difference of less than 5% was marked by "o". The measurement of the luminosity in this test was performed by using a differential colorimeter (CR-10: trade mark, Minolta Co.).

Water Absorption Test

The samples of the final particles were kept for 12 hours in two different conditions, i.e. in an environment of the normal temperature and humidity of 20° C. and 50% respectively (N/N), and in an environment of a high temperature and humidity of 30° C. and 85% respectively (H/H), and thereafter measured of their water contents. When a sample indicated a difference of not more than 0.05% in water content between these environments, the sample was marked by "o", and when sample indicated a difference of more than 0.05% in water content between these environments, the sample was marked by "x". The water content was measured by setting the sample-heating temperature to 200° C. taking 15 minutes according to Carl-Fisher method.

Followings are specific examples of this invention. All amounts shown in these examples are based on weight unless otherwise indicated.

EXAMPLE 1

Synthesis of Resin Particles

| Composition | |
|---|---|
| Styrene | 160 parts |
| n-butyl acrylate | 40 parts |
| Ammonium persulfate | 1 part |
| Deionized water | 800 parts |

Ammonium persulfate was dissolved in a deionized water to obtain an aqueous solution to which styrene and n-butyl acrylate were further added, and the resultant solution was allowed to a polymerization reaction for 8 hours in a 1-liter 4-necked flask at a stirring rate of 250 rpm and a temperature of 70° C. to obtain a dispersion containing resin particles 0.7 μm in average particle diameter dispersed therein.

Preparation of Hetero-Aggregates

| Composition | |
|---|---|
| Resin particle dispersion | 25 parts (resin particle: 5 parts) |
| Carbon black | 2 parts |
| Cationic oligomer | 0.5 part |
| Deionized water | 430 parts |

A solution comprising the above composition was mixed together with a stirring rod and dispersed for 10 minutes using an ultrasonic dispersing machine (Yamato Kagaku Co., BRAN SONB-12, trademark) to obtain a hetero-aggregate dispersion. The cationic oligomer employed was 1500 in weight-average molecular weight, the structural formula thereof being $CH_2{=}CR_1COO(CH_2)_n{-}NHR_2R_3$.

Preparation of Semi-Polymerizable Monomer

| | |
|---|---|
| Styrene | 4 parts |
| Azobisisobutylnitrile | 0.02 part |

A solution having the above composition was placed to stand in a vacuum dryer (Yamato Kagaku Co., DP-41) heated to 60° C. for 12 hours to obtain a viscous fluid having a weight-average molecular weight of 3,000,000.

Preparation of Polymerizable Monomer Composition

| | |
|---|---|
| Styrene | 28 parts |
| n-butyl acrylate | 8 parts |
| Azobisisobutylnitrile | 1.0 part |

A mixture having the above composition was fully stirred using a stirring rod, and then 4 parts of the resultant semi-polymerizable monomer was further stirred using a stirring rod to obtain a polymerizable monomer composition.

Preparation of a Composite Seed Particle Dispersion

To the aforementioned hetero-aggregate dispersion was added the aforementioned polymerizable monomer composition, and the resultant mixture was stirred by using a homogenizer (T.K.AUTO homomixer, Tokushu Kika Kogyo Co.) for 10 minutes at a stirring rate of 5,000 rpm to obtain a composite seed particle dispersion.

Synthesis of a Soap-Free Polymer Toner

The composite seed particle dispersion obtained above was transferred into a 1-liter four-necked flask, and after the addition of 0.1 part of ammonium persulfate as a soap-free polymerization initiator, the resultant reaction mixture was allowed to undergo the polymerization reaction thereof for 6 hours at a stirring rate of 80 rpm and a temperature of 80° C. to obtain a soap-free polymer toner having an average particle diameter of 10.0 μm. Subsequently, 0.3% by weight of silica was externally added to the soap-free polymer toner using an O.M. dizer (hybridizer NHS-O; trademark, Nara Kikai Co.) to finally obtain a toner.

This toner was then applied to a printer shown in FIG. 5 to perform a fogging test for evaluating the humidity resistance of the toner. As a result, a difference in fogging due to the change in environment was found to be not more than 5%, i.e. "o" in judgment, and a difference in water absorption coefficient due to the change in environment in the water absorption test was found to be not more than 0.05%, i.e. "o" in judgment, thus demonstrating an excellent humidity resistance of the toner.

EXAMPLE 2

The same procedures as explained in Example 1 were repeated except that 0.5 part of a self-emulsifiable polyethylene wax neutralized in advance with ammonia and having a weight-average molecular weight of 3,000 was added as a wax to the hetero-aggregate, thus obtaining a soap-free polymer toner having a volume-average particle diameter of 10.3 μm. Subsequently, 0.3% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be not more than 5%, i.e. ROS in judgment, and a difference in water absorption coefficient due to the change in environment in the water absorption test was found to be not more than 0.05%, i.e. ROS in judgment, thus demonstrating an excellent humidity resistance of the toner.

EXAMPLE 3

The same procedures as explained in Example 1 were repeated except that 0.5 part of CCA (Hoechst Japan Co. VP2038) was added as a charge controlling agent to the semi-polymerizable monomer and mixed in the semi-polymerizable monomer with a stirring rod, the resultant mixture being subsequently added to the polymerizable monomer containing an oil-soluble polymerization initiator, thus obtaining a soap-free polymer toner having a volume-average particle diameter of 10.5 μm. Subsequently, 0.3% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be not more than 5%, i.e. "o" in judgment, and a difference in water absorption coefficient due to the change in environment in the water absorption test was found to be not more than 0.05%, i.e. "o" in judgment, thus demonstrating an excellent humidity resistance of the toner.

EXAMPLE 4

The same procedures as explained in Example 1 were repeated except that 0.5 part of fine particles for external additive (Sohken Kagaku Co. MP2701) was added as a charge controlling agent to the semi-polymerizable monomer and mixed in the semi-polymerizable monomer with a stirring rod, the resultant mixture being subsequently added to and, by making use of a stirring rod, mixed with the polymerizable monomer containing an oil-soluble polymerization initiator, thus obtaining a soap-free polymer toner having a volume-average particle diameter of 10.6 μm. Subsequently, 0.3% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be not more than 5%, i.e. "o" in judgment, and a difference in water absorption coefficient due to the change in environment in the water absorption test was found to be not more than 0.05%, i.e. "o" in judgment, thus demonstrating an excellent humidity resistance of the toner.

EXAMPLE 5

The same procedures as explained in Example 1 were repeated except that the hetero-aggregate dispersion was mixed with the polymerizable monomer composition at a stirring rate of 4,000 rpm for 10 minutes, thus obtaining a soap-free polymer toner having a volume-average particle diameter of 7.5 μm. Subsequently, 0.5% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be not more than 5%, i.e. "o" in judgment, and a difference in water absorption coefficient due to the change in environment in the water absorption test was found to be not more than 0.05%, i.e. "o" in judgment, thus demonstrating an excellent humidity resistance of the toner.

EXAMPLE 6

The same procedures as explained in Example 5 were repeated except that the hetero-aggregate dispersion was mixed with the polymerizable monomer composition at a stirring rate of 3,000 rpm for 10 minutes, thus obtaining a soap-free polymer toner having a volume-average particle diameter of 4.8 μm. Subsequently, 0.8% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be not more than 5%, i.e. "o" in judgment, and a difference in water absorption coefficient due to the change in environment in the water absorption test was found to be not more than 0.05%, i.e. "o" in judgment, thus demonstrating an excellent humidity resistance of the toner.

COMPARATIVE EXAMPLE 1

The same procedures as explained in Example 1 were repeated except that the semi-polymerizable monomer was not added to the polymerizable monomer composition, thus obtaining a soap-free polymer toner having a volume-average particle diameter of 10.5 μm. However, the yield of the soap-free polymer toner was as low as 30%, concurrently producing a large amount of finer particles. Subsequently, 0.3% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be 6%, i.e. "x" in judgment, and a difference in water absorption coefficient due to the change in environment in the water absorption test was also found to be 0.1%, i.e. "x" in judgment, thus failing to obtain an aimed humidity resistance. The reason for this result can be attributed to the fact that since a fairly large amount of fine particles had been produced in the manufacture of the toner, the free colorant from the hetero-aggregation process was not sufficiently incorporated into the composite seed particles during the preparation of the composite seed particles, thus allowing a large amount of the free colorant to remain in the dispersion and thereby to contaminate the surface of the polymer toner during the polymerization of the soap-free polymerization.

COMPARATIVE EXAMPLE 2

The same procedures as explained in Example 1 were repeated except that the soap-free polymerization initiator was not employed in the synthesis of the soap-free polymer toner, thus obtaining a soap-free polymer toner having a volume-average particle diameter of 6.5 μm. Subsequently, 0.5% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be 10%, i.e. "x" in judgment, and a difference in water absorption coefficient due to the change in environment in the water absorption test was also found to be 0.2%, i.e. "x" in judgment, thus failing to obtain an aimed humidity resistance. This indicates that the surface of the toner is required to be covered with a soap-free polymerization layer in the final step for achieving an improvement in humidity resistance of the toner.

COMPARATIVE EXAMPLE 3

| Composition | |
|---|---|
| Styrene | 60 parts |
| n-butyl acrylate | 40 parts |
| Acrylic acid | 8 parts |
| Potassium persulfate | 1 part |
| Deionized water | 800 parts |
| Nonionic emulsifier | 1 part |
| Anionic emulsifier | 1.5 part |

A solution having the above composition was allowed to polymerize with stirring at a temperature of 70° C. for 8 hours. To the resultant resinous emulsion were added 5 parts of carbon black and 400 parts of deionized water, and then mixed by using a slasher. The resultant mixture was then held for 2 hours at a temperature of 30° C. to obtain primary particle about 2 μm in particle diameter. Subsequently, the pH of the primary particle was turned to acidic to agglomerate the primary particles into secondary particles, which were then subjected to aging at a temperature of 70° C. for 3 hours thus causing the particles to be fused to each other to obtain a polymer toner having a volume-average particle diameter of 9.7 μm according to an emulsion polymerization particle-agglomeration method. Subsequently, 0.5% by weight of silica was externally added to this polymer toner to finally obtain a toner.

The toner thus obtained was then applied to a printer shown in FIG. 5 to perform a fogging test for evaluating the humidity resistance of the toner. As a result, a difference in fogging due to the change in environment was found to be 15%, i.e. "x" in judgment, and a difference in water absorption coefficient due to the change in environment in the water absorption test was also found to be 0.5%, i.e. "x" in judgment, thus giving rise to the humidity resistance of the toner.

COMPARATIVE EXAMPLE 4

The same procedures as explained in Example 3 were repeated except that 0.5 part of CCA (Hoechst Japan Co. VP2038) was added to the hetero-aggregate dispersion, thus obtaining a soap-free polymer toner having a volume-average particle diameter of 10.7 μm. Subsequently, 0.3% by weight of silica was externally added to this soap-free polymer toner in the same manner as in Example 1, whereby finally obtaining a toner.

The toner thus obtained was then applied to a printer shown in FIG. 5 to perform a fogging test for evaluating the humidity resistance of the toner. As a result, a difference in fogging due to the change in environment was found to be 8%, i.e. "x" in judgment, and a difference in water absorption coefficient due to the change in environment in the water absorption test was also found to be 0.1%, i.e. "x" in judgment, thus failing to obtain an aimed humidity resistance though the humidity resistance thereof was not so bad as that obtained according to the emulsion polymerization particle-agglomeration method.

The reason for this result can be attributed to the fact that since a fairly large amount of fine particles had been produced in the manufacture of the toner, the free colorant or CCA from the hetero-aggregation process due to the addition of CCA in an aqueous medium was not sufficiently incorporated into the composite seed particles during the preparation of the composite seed particles, thus allowing a large amount of the free colorant or CCA to remain in the dispersion and thereby to contaminate the surface of the polymer toner during the polymerization of the soap-free polymerization.

COMPARATIVE EXAMPLE 5

| Composition | |
|---|---|
| Styrene | 100 parts |
| Carbon black | 5 parts |
| Azobisisobutylnitrile | 1.2 part |

The mixture of the above composition was added to an aqueous solution having the following composition.

| Composition | |
|---|---|
| Tricalcium phosphate | 3 parts |
| Deionized water | 500 parts |

The resultant mixture was agitated with a homogenizer until the oily particles in the liquid could not be minimized any further (about 5 or 6 μm). Then, the resultant mixture was allowed to suspension polymerization in an ordinary polymerization reaction vessel for 10 hours under the conditions of 100 rpm and 60° C. to obtain a polymer toner having a volume-average particle diameter of 5.5 μm. Subsequently, 0.7% by weight of silica was externally added to this polymer toner to finally obtain a toner.

The toner thus obtained was then applied to a printer shown in FIG. 5 to perform a fogging test for evaluating the humidity resistance of the toner. As a result, a difference in fogging due to the change in environment was found to be 10%, i.e. "x" in judgment, and a difference in water absorption coefficient due to the change in environment in the water absorption test was also found to be 0.3%, i.e. "x" in judgment, thus giving rise to the humidity resistance of the toner though the humidity resistance thereof was not so bad as that obtained according to the emulsion polymerization particle-agglomeration method. It was found impossible to further minimize the particle diameter when the suspension polymerization was employed.

The results of these Examples and Comparative Examples are summarized in the Table 1 shown below.

TABLE 1

| | Humidity resistance-fogging test | Water-absorption test | Toner size (μm) |
|---|---|---|---|
| Ex. 1 | o | o | 10.0 |
| Ex. 2 | o | o | 10.3 |
| Ex. 3 | o | o | 10.5 |
| Ex. 4 | o | o | 10.6 |

TABLE 1-continued

| | Humidity resistance-fogging test | Water-absorption test | Toner size (μm) |
|---|---|---|---|
| Ex. 5 | o | o | 7.5 |
| Ex. 6 | o | o | 4.8 |
| Com. Ex. 1 | x | x | 10.5 |
| Com. Ex. 2 | x | x | 6.5 |
| Com. Ex. 3 | x | x | 9.7 |
| Com. Ex. 4 | x | x | 10.7 |
| Com. Ex. 5 | o | x | 5.5 |

As explained above, the present invention adopts a soap-free polymerization method in manufacturing a developing agent, whereby solving the problem of humidity resistance accompanied with the conventional emulsion polymerization method as well as the problem of narrow controllable range of particle diameter accompanied with the conventional suspension polymerization method. Furthermore, various problems accompanied with the conventional soap-free polymerization method, such as the poor dispersion of toner components, the problem of enlarging the particle size and the problem of controlling the particle diameter have been solved according to this invention by the employment of semi-polymerizable monomer and by the enlargement of particles through the agitation in an aqueous medium of a composition comprising a polymerizable monomer (the generation of a composite seed particle). Therefore, it is possible according to this invention to provide a soap-free polymer toner for use in electrophotography, which is excellent in humidity resistance and whose particle diameter can be controlled to a wide range of from submicron to several tens microns.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a developing agent, comprising the steps of:

forming an aggregate containing resin particles and a colorant in an aqueous solution;

forming a dispersion by dispersing said aggregate, a first polymerizable monomer, a semi-polymer, and an oil soluble polymerization initiator in the aqueous solution, said semi-polymer obtained by partially polymerizing a second polymerizable monomer, wherein the semi-polymer has a polymerized portion in a ratio of less than 50% by weight of the semi-polymer, and wherein said polymerized portion has a weight-average molecular weight of 1 million to 4 million;

forming a composite seed containing the aggregate, the first polymerizable monomer, the semi-polymer, and the oil soluble polymerization initiator by stirring said dispersion to granulate the aggregate; and polymerizing said composite seed using a soap-free polymerization initiator selected from the group consisting of ammonium persulfate, sodium persulfate, potassium persulfate, N,N'-diethylaminoethyl methacrylate, isobutylamido hydrochloric acid, polyoxyethylene methacrylate, dimethylaminoethyl methacrylate, and diethylaminoethyl methacrylate.

2. The method according to claim 1, wherein the dispersion comprises an amount of said semi-polymer based on said first polymerizable monomer plus semi-polymer in the range of 2 to 15% by weight.

3. The method according to claim 1, wherein said semi-polymer is used with a charge controlling agent.

4. The method according to claim 1, wherein an amount of said oil-soluble polymerization initiator based on said first polymerizable monomer plus semi-polymer in the dispersion is in the range of 0.01 to 10% by weight.

5. The method according to claim 1, wherein particle diameters of said composite seed particle and said developing agent are controlled by adjusting agitation conditions of said aqueous dispersion.

6. The method according to claim 1, wherein particle diameter of said composite seed particle is in the range of 0.1 to 1 μm.

7. The method according to claim 1, wherein particle diameter of said developing agent is in the range of 1 to 100 μm.

8. A developing agent produced by a method as claimed in claim 1.

9. The method according to claim 1, wherein the aggregate further comprises a wax.

10. The method according to claim 1, wherein the aggregate in the aqueous solution is formed by preparing a negative-charge resin particle via soap-free polymerization, mixing the resin particle with the colorant which is dispersed in a positively charged aqueous medium, and electrostatically agglomerating the mixture of resin and colorant.

11. The method according to claim 1, wherein the dispersion is formed by mixing the first polymerizable monomer with the oil-soluble polymerization initiator to prepare a first solution, mixing the semi-polymer with a charge controlling agent to prepare a second solution, and then mixing the first and second solutions.

12. The method according to claim 1, wherein the semi-polymer has a polymerized portion in a ratio of 10 to 40% by weight of the semi-polymer.

13. The method according to claim 1, wherein the resin particles have an average particle diameter in the range of 0.1 to 1 micrometer.

14. A method according to claim 1, wherein the aqueous solution includes an anionic dispersant.

15. A method according to claim 14, wherein the dispersant comprises an amine.

16. A method according to claim 1, wherein the first polymerizable monomer comprises a monovinyl aromatic monomer, an acryl monomer, a vinylester monomer, a vinylether monomer, a diolefin monomer, or a monolefin monomer.

17. A method according to claim 1, wherein the oil soluble polymerization initiator comprises an azo compound or a peroxide.

18. A toner composition comprising a developing agent made according to claim 1.

* * * * *